US009204711B2

(12) United States Patent
Schaffer

(10) Patent No.: US 9,204,711 B2
(45) Date of Patent: Dec. 8, 2015

(54) ADHESIVE BACKED FINGER HOLDS AND PURLICUE STOP FOR FITMENT TO HANDHELD DEVICES

(71) Applicant: Robin Schaffer, Englewood, CO (US)

(72) Inventor: Robin Schaffer, Englewood, CO (US)

( * ) Notice: Subject to any disclaimer, the term of this patent is extended or adjusted under 35 U.S.C. 154(b) by 0 days.

(21) Appl. No.: 14/465,372

(22) Filed: Aug. 21, 2014

(65) Prior Publication Data

US 2015/0054297 A1 Feb. 26, 2015

Related U.S. Application Data

(60) Provisional application No. 61/959,517, filed on Aug. 26, 2013.

(51) Int. Cl.

| | |
|---|---|
| ***B65G 7/12*** | (2006.01) |
| ***A45F 5/10*** | (2006.01) |
| ***A45F 5/00*** | (2006.01) |

(52) U.S. Cl.

CPC ... *A45F 5/10* (2013.01); *A45F 5/00* (2013.01); *A45F 2005/008* (2013.01)

(58) Field of Classification Search

CPC ..... A61F 13/105; G06F 1/1626; G06F 1/163; G06F 1/1628; Y10S 224/93; A45F 2005/1073; A45F 5/00; A45F 5/02; A45F 5/10; A45F 2005/008; F16M 13/04; B66C 1/66; B25B 33/00; A61C 19/006; A47G 29/08; B25G 1/102; B60R 9/055; B43L 15/00

USPC ..... 294/25; D14/447, 253; 224/217

See application file for complete search history.

(56) References Cited

U.S. PATENT DOCUMENTS

| | | | | |
|---|---|---|---|---|
| 5,722,575 | A | 3/1998 | Smith | |
| 6,028,765 | A | 2/2000 | Swindler | |
| 7,286,803 | B2 | 10/2007 | Hamasaki | |
| 7,661,567 | B2 | 2/2010 | Myers | |
| 8,124,216 | B2 | 2/2012 | Antonini | |
| D668,649 | S | 10/2012 | Burke | |
| 8,480,144 | B2 | 7/2013 | Potter | |
| 8,528,798 | B2 * | 9/2013 | Chen | 224/217 |
| 8,579,112 | B2 * | 11/2013 | Bethea | 206/320 |
| 2005/0205623 | A1 * | 9/2005 | Buntain | 224/217 |
| 2007/0181620 | A1 | 8/2007 | Carver, III | |
| 2008/0018123 | A1 | 1/2008 | Cox | |
| 2008/0083797 | A1 | 4/2008 | Myers | |
| 2009/0283559 | A1 | 11/2009 | Foggiato | |
| 2011/0266316 | A1 * | 11/2011 | Ghalib et al. | 224/217 |
| 2011/0309117 | A1 | 12/2011 | Roberts | |
| 2012/0031937 | A1 * | 2/2012 | Baker | 224/217 |
| 2012/0055960 | A1 * | 3/2012 | Chen | 224/101 |
| 2012/0299318 | A1 | 11/2012 | Murphy | |
| 2012/0319414 | A1 * | 12/2012 | Potter et al. | 294/25 |
| 2013/0119099 | A1 | 5/2013 | Interdonato | |
| 2013/0146625 | A1 | 6/2013 | Karle | |

* cited by examiner

*Primary Examiner* — Stephen Vu

(74) *Attorney, Agent, or Firm* — Leyendecker & Lemira LLC; Kurt Leyendecker

(57) ABSTRACT

Finger holds that are adhesively secured and form ridges jutting downwardly from the back surface of an associated handheld device are described. Each finger hold provides a location by which the user's finger tip can brace and consequently permit the user to better grip and hold the device with a single hand.

15 Claims, 8 Drawing Sheets

ADHESIVE BACKED FINGER HOLDS AND PURLICUE STOP FOR FITMENT TO HANDHELD DEVICES

RELATED APPLICATION

The present application claims priority to and incorporates by reference U.S. Provisional Application 61/959,517 entitled Adhesive backed soft plastic finger-tip bumpers for hand-held devices filed on Aug. 26, 2013 and having the same inventorship as the present application.

FIELD OF THE INVENTION

The present invention pertains generally to accessories for hand-held devices.

BACKGROUND

The marketplace has seen the proliferation of many types of personal, hand-held, electronic devices in the last decade or so. These devices include tablet computers, such as but not limited to the Apple iPad®, smartphones and electronic readers, such as the Amazon Kindle®.

These devices are often held with a single hand with the four fingers cradling the back of the device and the thumb resting on the front side of the device. For smaller devices, such as smart phones, a user may even use the thumb to trigger the touch screen on the device's front. The back sides of most of these devices are relatively flat, often smooth and even slick. The backside surface often does not provide a means for the user to grip the device with his/her four finger tips especially with the larger devices, such as the tablet computers. The devices merely rest on the fingers and are subject to be dropped especially if they are being supported by a single hand.

Some of the items available to assist a user in holding his/her device include covers with rubberized and/or textured surfaces that purport to increase the amount of friction between a user's hand and the device. These items, however, do not provide a means that allow the user to more securely grip the electronic device and can become more slick when encountering moisture, such as from perspiration, and over time with the exposure to oils in the user's hand.

Aftermarket accessories including covers incorporating loops, rings and/or straps into which the user places his/her fingers or hands are known. While secure, they can be overly cumbersome hindering the ability of a user to remove his or her fingers from the accessory to let go of the device. In fact, a second hand is often required just to free the holding hand. Further, placing the device on a surface backside down can be frustrating as the thickness of the strap, loops and/or rings and its positioning on the device prevent a user from being able to lay it relatively flat. As yet another frustration, the positioning of the hand holding features is often fixed relative to the device not permitting a user to place the feature in a position that bests suits him or her.

DETAILED DESCRIPTION

Figure 1:
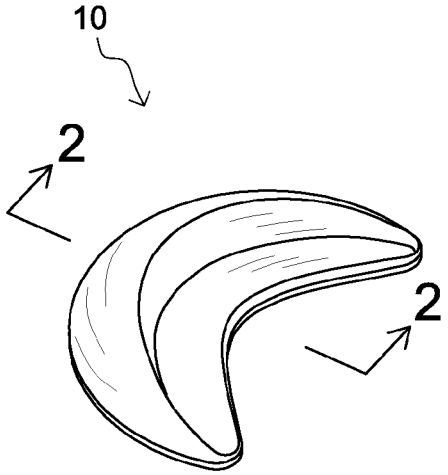
FIG. 1 is an isometric top view of a finger hold accordingly to one embodiment of the present invention.

Embodiments of the present invention comprise a plurality of finger holds that are adhesively secured and form ridges jutting downwardly from the back surface of an associated handheld device. Each finger hold provides a location by which the user's fingertip can brace and consequently permit the user to better grip and hold the device with a single hand.

Typically, a finger hold is provided for each finger and since the each finger hold is separate and distinct from the others, they can each be placed at a location most suited to the finger of a particular user with which the hold is to interface. Accordingly, a user with a smaller hand may place the holds closer to the edge of the device compared to a user with large hands.

Embodiments of the holds are comprised of a soft plastic or an elastomer which give and elastically deform slightly when in use to facilitate a better grip. Variations are contemplated made of more rigid materials and yet other variations utilize materials having a tacky surface to further enhance grip. Other variations are contemplated made of a polymeric material that can be at least partially custom formed to more exactly match the contours of a particular user's fingertips. The material can be one that is activated by the user, such as heating the material to an activation temperature, wherein the material molds around the user's fingertips and then takes a permanent set, or the material can be one that more slowly and gradually deforms and molds to the contours of the user's fingertips over time and with use.

Other embodiments of the present invention comprise a stop that wraps around the edge of the handheld device wherein the stop rests upon the portion of the hand wherein the thumb and forefinger are joined filing in the space known as the purlicue. Variations of the stop include a thumb portion that extends upwardly along the edge of the device to provide a ridge against which a user can brace his or her thumb. In combination with the finger holds, the griping force and security with which a user can hold his or her device is significantly increased over the use of the finger holds alone. Additional embodiments of the invention also include the purlicue stop provided in combination with a plurality of the finger holds.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The terms "removable", "removably coupled", "removably installed," "readily removable", "readily detachable", "detachably coupled", "separable," "separably coupled," and similar terms, as used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

Directional or relational terms such as "top," bottom," "front," "back," "above," "beneath," and "below," as used in this specification and appended claims, refer to relative positions of identified elements, components, or objects, where the components or objects are oriented in an upright position as normally installed or used.

The phrase "Handheld Device" as used herein refers to any device held in the hand often with a single hand but also with two hands. For purposes of this definition, a clipboard or book would be a handheld device. A "handheld electronic device" refers to a handheld device incorporating electronics and a screen that encompasses a significant portion of a front side and includes a substantially flat back side. Handheld electronic devices include, but are not limited to, smart phones, tablet computers and electronic readers. As used herein, the phrase is also intended to apply to an electronic handheld device in combination with any case received on it.

The term "arcuate" as used herein refers to a curved surface or line. The curved surface or line need not comprise an arc or portion of circle, but may also comprise a portion of an oval or other shape comprising a curved surface. Accordingly, the terms "radius" and "effective radius" refer to the radius a circle that most closely matches with the referenced arcuate surface or line.

The phrase "integrally formed" or the term "integral" as used herein refers to something that is a portion of the whole. For instance, integrally formed portions are portions of the whole that are formed from the same base material and at essentially the same time as the whole.

A First Embodiment of a Finger Hold For Handheld Devices

Figure 2:
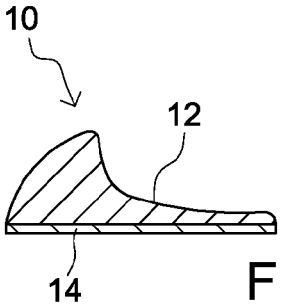
FIG. 2 is a cross sectional side view of the finger hold of FIG. 1 taken along lines 2-2 according to one embodiment of the present invention.
Figure 3:
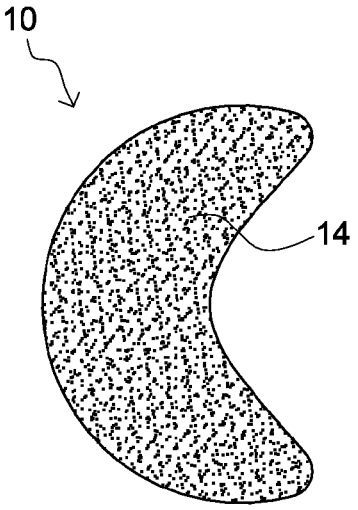
FIG. 3 is a bottom view of the finger hold of FIG. 1 according to one embodiment of the present invention.
Figure 7:
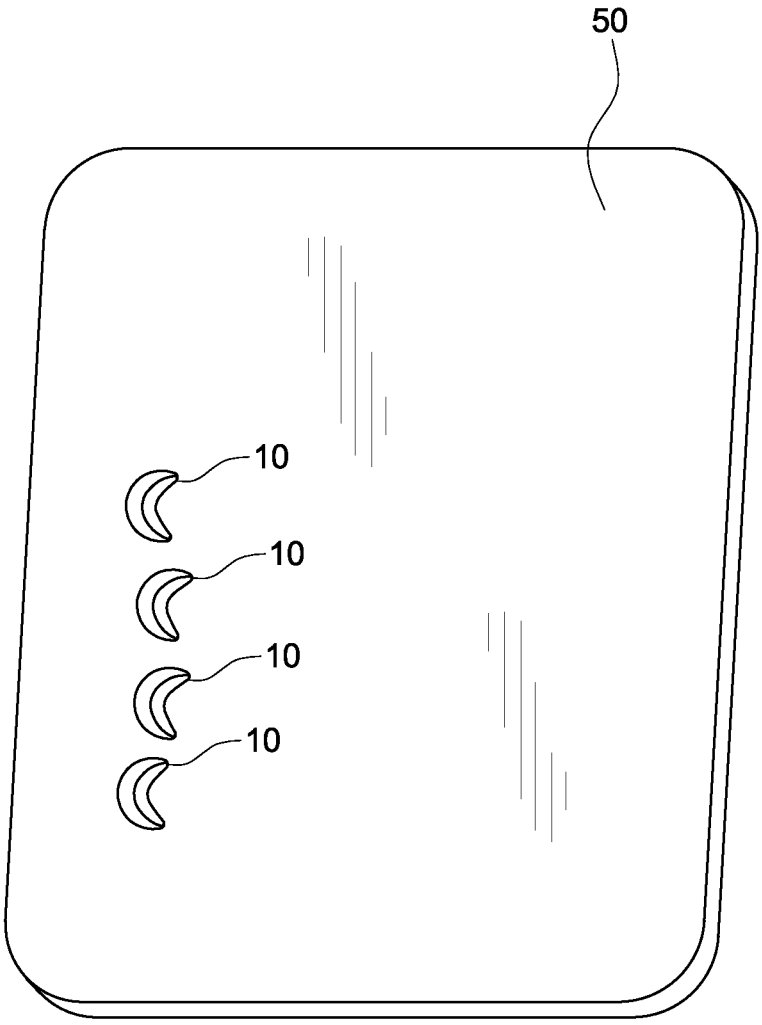
FIG. 7 is an isometric view of a series of finger holds installed on the backside of a handheld electronic device according to one embodiment of the present invention.
Figure 8:
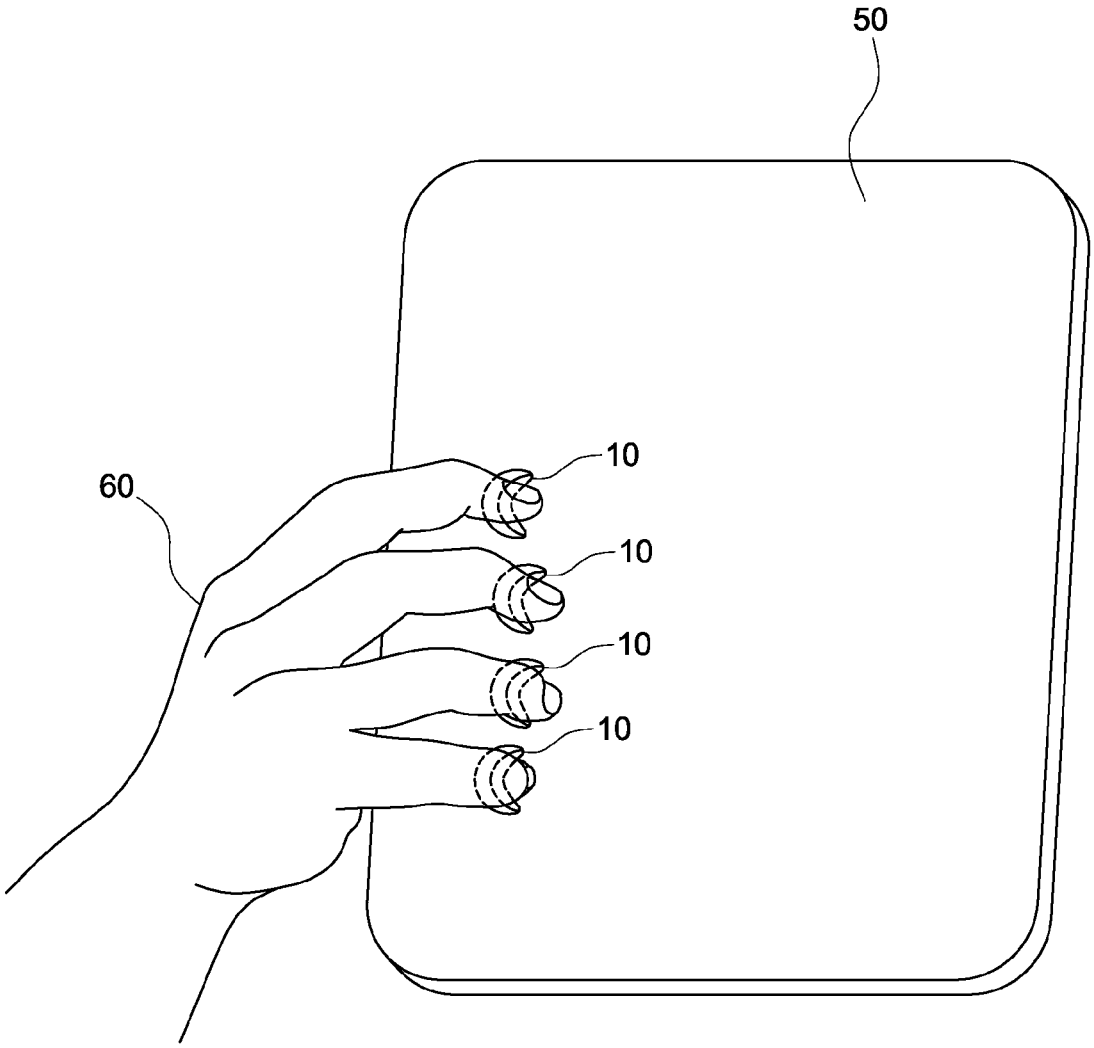
FIG. 8 is an isometric view of a series of finger holds installed on the backside of a handheld electronic device with the finger tips of a hand of a user received in the finger holds according to one embodiment of the present invention.

FIGS. 1-3 illustrate several views of a first embodiment finger hold. FIGS. 7 & 8 show generally where the finger holds are placed on the backside of a handheld electronic device and how the finger tips of a user are placed in or against the finger holds to facilitate a better grip and hold on the device.

Referring to the figures, a typical finger hold 10 comprises a crescent-shaped piece or bumper that forms an arcuate ridge and associated ridge face 12 sized to generally receive and cradle a finger tip. The arcuate ridge typically has a radius of less than 1.0" As can be appreciated, the ridge need not be perfectly arcuate having a flatter (or larger radius section) in its middle and a tighter radius near the ends. Holds having different shapes are also contemplated. For instance, the finger hold could comprise substantially first linear section, or a linear section bounded by shorter second and third linear sections that extend from the first orthogonally.

FIG. 2 shows a cross section of the bumper taken along lines 2-2 of FIG. 1. Of note, the ridge face (or surface) 12 forms a concave radius the rises up from a base and becomes substantially vertical near a top end. The shape helps a user more comfortably grip the finger hold than a surface that rose substantially vertically. Other shapes and configurations of the ridge face are also contemplated. Of note, while the ridge is described as rising, it is to be appreciated that in use the ridge will most likely extend downwardly from the back side of a device to which it is attached.

The bumper can be made of any suitable material but is generally comprised of a polymeric material. In some variations, an elastomer is specified having a Shore A durometer hardness of less than 70 and more preferably a Shore A durometer of between 10 and 45. In at least one variation, the bumper is comprised of Santoprene® manufactured by ExxonMobil Chemical. In other variations, the elastomer may be of the tacky variety, such as is used with car dash gel pads, wherein the stickiness of the material assists in holding a user's fingers firmly in place. In yet other variations, the finger holds can comprise rigid plastic or any other suitable material including but not limited to metal and wood. Further, the material can comprise a moldable material in which the user can mold the bumpers to match the contours of his/her fingertips.

FIG. 3 comprises a bottom view of the finger hold of FIG. 1. The bottom side of the finger hold comprises a layer 14 of pressure sensitive adhesive that when a release layer is removed facilitates attachment of the finger hold to the back side of a device. In some variations, the hold is provided without an attached adhesive layer and separately provided adhesive tape, liquid or paste form is applied to one or both the back side of the device and the bottom side of the hold prior to joining.

Figure 4:
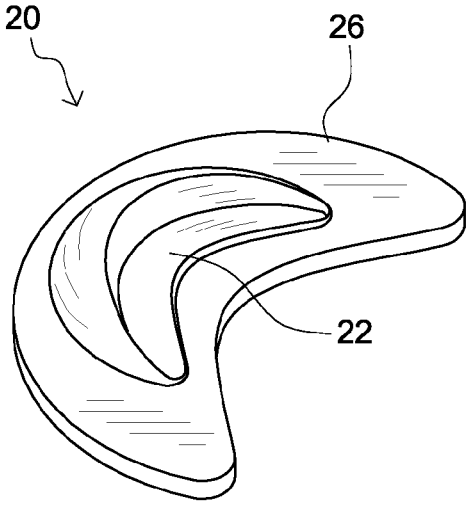
FIG. 4 is an isometric view of finger hold incorporating a foot pad according to another embodiment of the present invention.

FIG. 4 is an illustration of a finger hold 20 having a bumper 22 (or raised portion) with a configuration similar to the finger hold of FIG. 1, but further including a flat and planar foot 26 (or base portion) surrounding and extending outwardly from the bumper. Typically, the foot and bumper are integrally formed as a single piece from the same material. The foot provides additional surface area to better adhere the finger hold 20 to the back side of an applicable device either with the use of an adhesive or without where a tacky gel-type elastomer is used.

Figure 5:
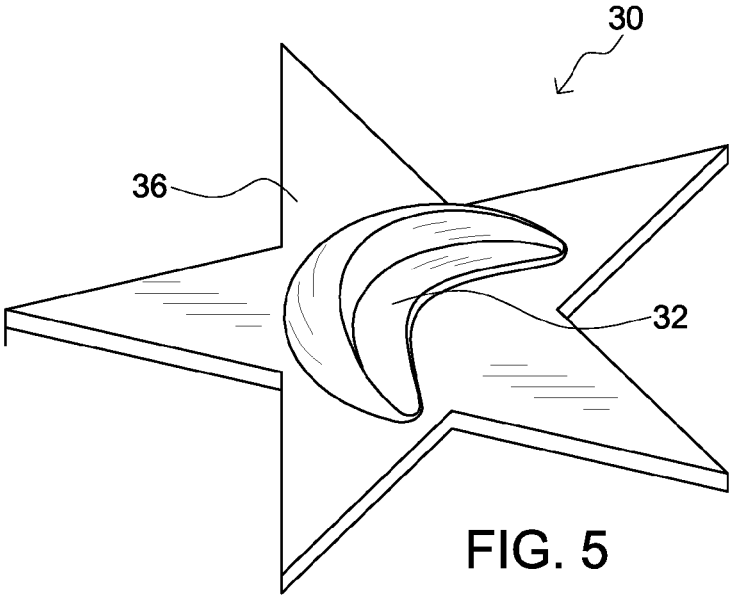
FIG. 5 is an isometric view of finger hold incorporating a decorative foot pad according to another embodiment of the present invention.

The finger hold 30 and the bumper 32 of FIG. 5 are substantially similar to the hold of FIG. 4 except the perimeter of the foot 36 is in the shape of a star. As can be appreciated, feet of many different shapes are contemplated, such as but not limited to hearts, football helmets, crosses and star bursts. In a typical package of four finger holds each finger hold can have the same foot or packages with differently shaped feet can be provided. In other variations, the finger holds in any one package can comprise the same or different colors. Feet with indicia embossed or printed thereon are also contemplated.

A Second Embodiment of a Finger Hold for Handheld Devices

Figure 6:
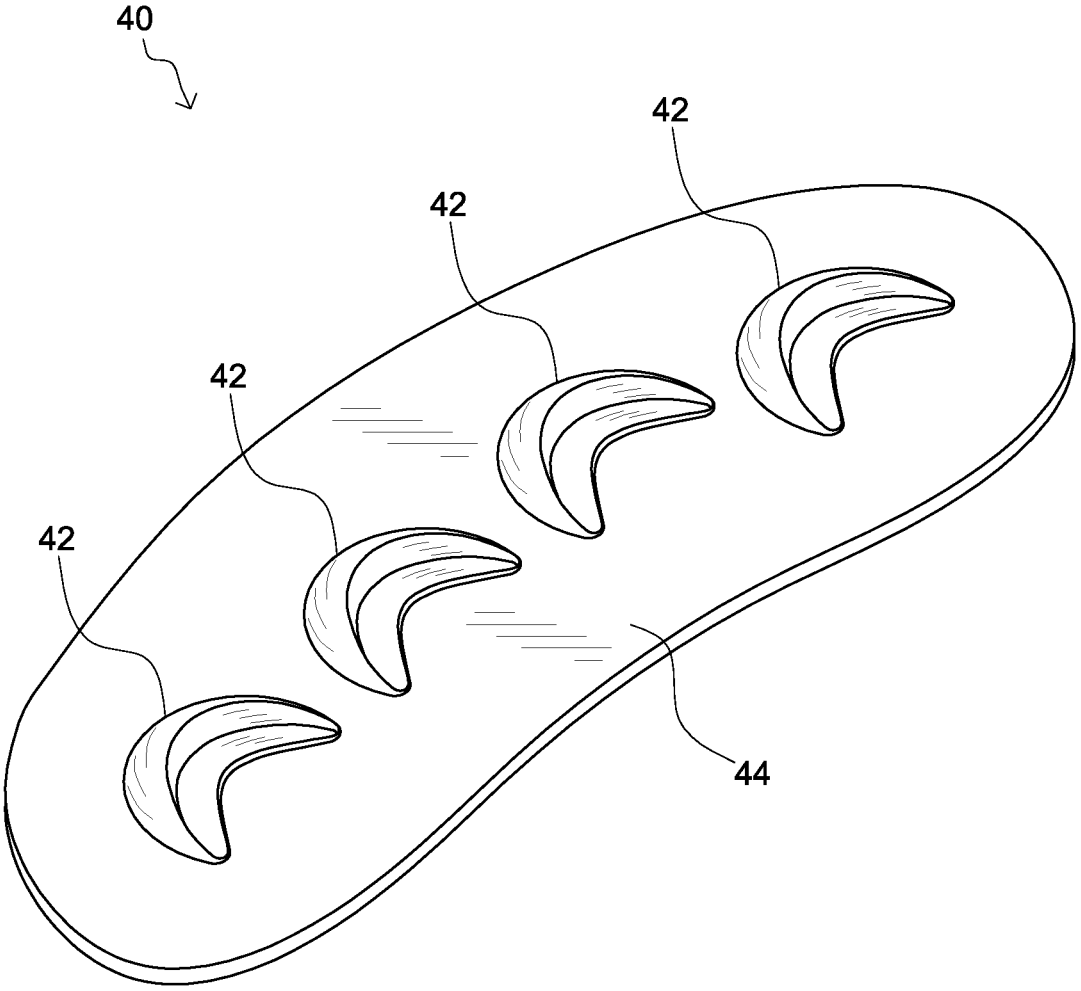
FIG. 6 is an isometric view of a finger hold device incorporating four holds integrally coupled by a foot pad according to yet another embodiment of the present invention.

A single unit finger hold 40 is shown in FIG. 6. In this embodiment, each bumper 42 is integrally joined to each other bumper 42 by way of a large planar foot 44. This embodiment can be comprised of any of the same materials as described relative to the preceding embodiment and variations thereof. An adhesive layer can be provided on the backside to facilitate a secure attachment to the back side of an associated device or the hold can be self adhering if it is comprised of a tacky gel-type polymer.

In one variation of this embodiment 40, the bumpers 42, which rise above the surface of the foot 44, are replaced with depressions that extend into the foot. The shape of the depressions can vary and are not necessarily minors of the bumpers but serve essentially the same purpose as the bumpers by providing a user a place to place his/her fingertips to exert leverage and grip on the device.

A Method of Installing the Finger Holds and Using a Device with Finger Holds

Typically, a four finger holds are used together to provide a user with a location for each of his/her fingertips to grasp the associated handheld device. Each finger hold is individually placed on the device's back side and adhesively secured in place. FIG. 7 illustrates the back side of an electronic device 50 having four finger holds 10 secured thereto. Of important note, the reference to the back side of an electronic device is intended to include not only the direct back side of the device but also the back side of any case or cover into which the device has been received. Consequently, for purposes of this disclosure and the depended claims finger holds secured to or installed on a back side of a handheld electronic device would include finger holds installed on the back side of the device's case.

To install the finger holds, the user first cleans the surface of the backside of the identified device or device cover in the regions to which the holds are to be adhesively secured. Cleaning can be accomplished by any suitable means including the use of soaps, detergents and solvents to remove oils, dirt and other contaminants that might interfere with the adherence of each hold to the backside. The user determines the locations at which he/she normally holds/grasps the identified device. The locations for each finger are marked and/or noted by any suitable means.

Next, the finger holds are adhesively installed proximate each of the locations with the open portion of the arcuate ridge facing generally away from the user's palm. In some variations, adhesively installing each hold comprises removing the release paper from the pre-attached pressure sensitive adhesive layer and pressing the exposed adhesive layer against the back side. In another variation, the adhesive in liquid, tape or paste form is applied to one or both the finger hold and the back side and brought together. In yet another variation comprised of a tacky gel-type polymer, the clean bottom side of the hold is placed against the back side and pressed in place.

Once all four holds have been secured in place (variations utilizing two or three holds are also contemplated), the device is ready for use. FIG. 8 illustrates a user's hand 60 gripping an electronic handheld device 50 through use of installed finger holds. In use the user places each of his/her fingers within or against the holds resting his/her fingertips on the back side of the device and against the finger hold ridge. The hand wraps around the device with the thumb and palm further stabilizing the device and ensuring a proper grip thereon.

An Embodiment of a Purlicue Stop for Handheld Devices

The purlicue comprises the space between a thumb and an adjacent forefinger finger of a hand. When holding a handheld device the purlicue is at least partially filled with the edge of the device as can be seen in FIG. 11*b* for example, wherein the thumb wraps around the front surface of the device and the fingers are received against the backside of the device. A purlicue stop 70 is illustrated in FIGS. 9-11*c* that when installed wraps around the edge of a handheld device and projects there from into the purlicue of a hand holding the device. When the device is being held, the stop rests against the portion of the hand extending between the thumb and the adjacent forefinger. Effectively the purlicue stop provides another interface between the user's hand and the device increasing the security with which the device is held especially when held with a single hand. The purlicue stop is often used in conjunction with the finger holds described above to facilitate even a more firm and secure grip on a hand held device.

Figure 9:
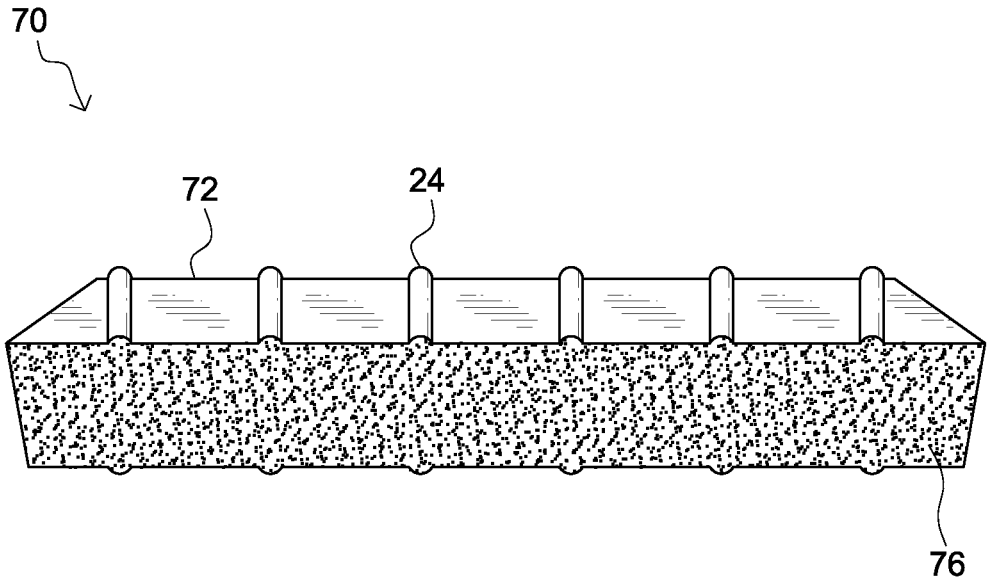
FIG. 9 is an isometric view of a purlicue stop for mounting to the side edge of a handheld device shown in its unfolded or unbent configuration prior to installation according to one embodiment of the present invention.
Figure 10:
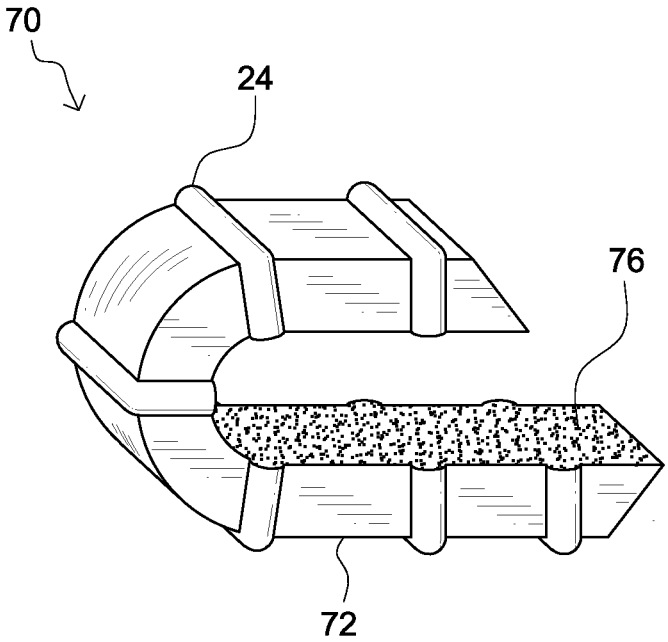
FIG. 10 is an isometric side view of the purlicue stop in its as installed configuration with the hand held device omitted for clarity according to one embodiment of the present invention.
Figure 11A:
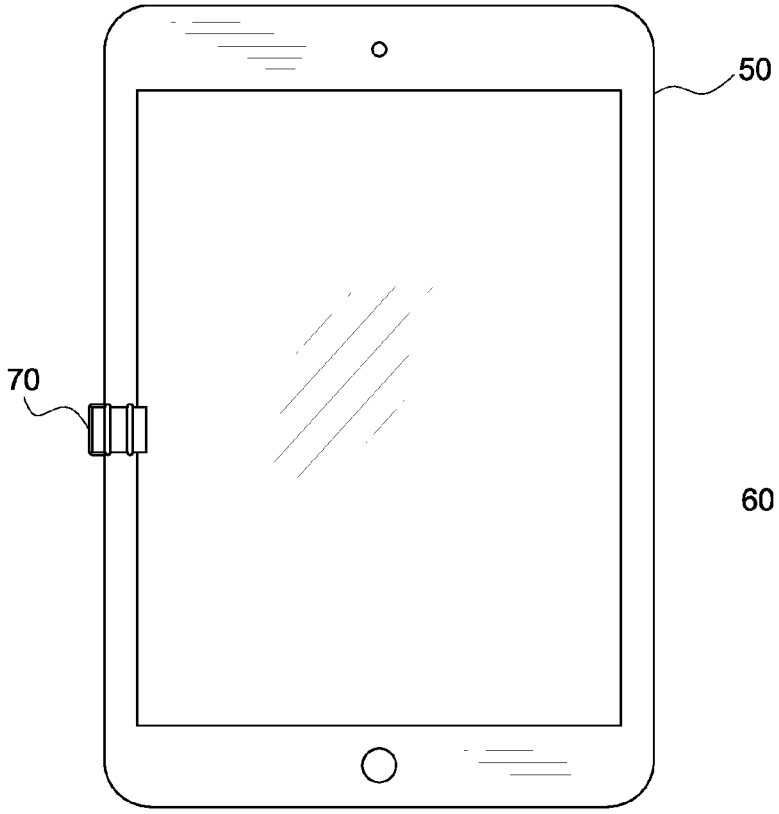
FIGS. 11*a-c* are respective front side and top views of the purlicue stop installed on a handheld electronic device according to one embodiment of the present invention.
Figure 11B:
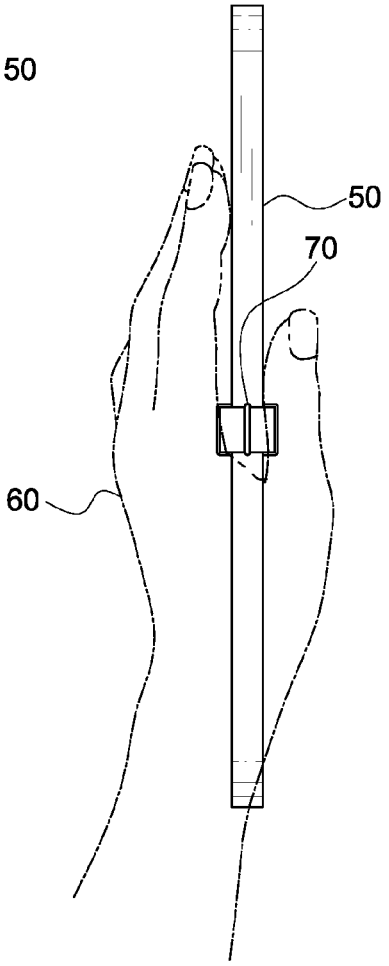

Referring to FIGS. 9 & 10, an embodiment of a typically purlicue stop 70 is illustrated. FIG. 9 shows a typical stop 70 as it is fabricated. It typically is comprised of a flexible elastomeric material having a moderate level of firmness, although it can be comprised of any of the materials used in the finger holds. The unit is typically unitarily molded as a single piece.

It comprises an elongated body, typically arcuate body 72 that extends outwardly of a substantially flat bottom side. In the illustrated embodiment but not necessarily all embodiments, ribs extend laterally around the body from one edge with the bottom side to the opposing and opposite edge. Adjacent ribs 74 provide a place for the web of skin spanning between the thumb and forefinger to reside and provide lips that help ensure a sure connection between the device and the hand.

The bottom side includes an adhesive layer 76, which is used to secure the stop 70 to the handheld device as well as hold the stop in its curved as installed configuration, such as shown in FIG. 10 and FIGS. 11*a-c*. As can be appreciated, the adhesive layer typically includes a release film covering the adhesive that is removed just prior to installation and use.

Figure 11C:
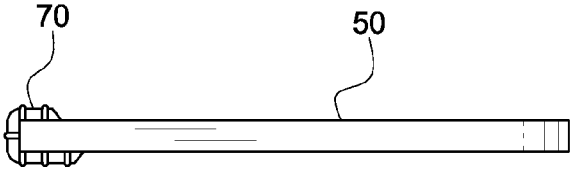

As mentioned above the stop is often used in conjunction with finger holds and is installed on the device in a similar manner: the location is identified; the area is cleaned to remove dirt, oils and other contaminants; the release film is removed from the adhesive layer, and the stop is wrapped around the edge of the handheld device and pressed upon to secure it in place. Of note, in typical configurations as shown in FIG. 11*c* the stop extends a greater distance along the backside of the device than it does along the top side.

As described above the material comprising the body is flexible enough to easily bend around and conform to the edge of the device. In at least one variation a malleable wire or rod is inserted or molded into the proximate longitudinal center of the body. In this variation, the wire takes a set when the stop is bent around the edge of the device and assists in holding the stop in the u-shaped configuration. In yet another variation, a thin strip of metal is provided between the bottom surface of the body and the adhesive layer to serve a similar purpose.

A Second Embodiment of a Purlicue Stop for Handheld Devices

Figure 12:
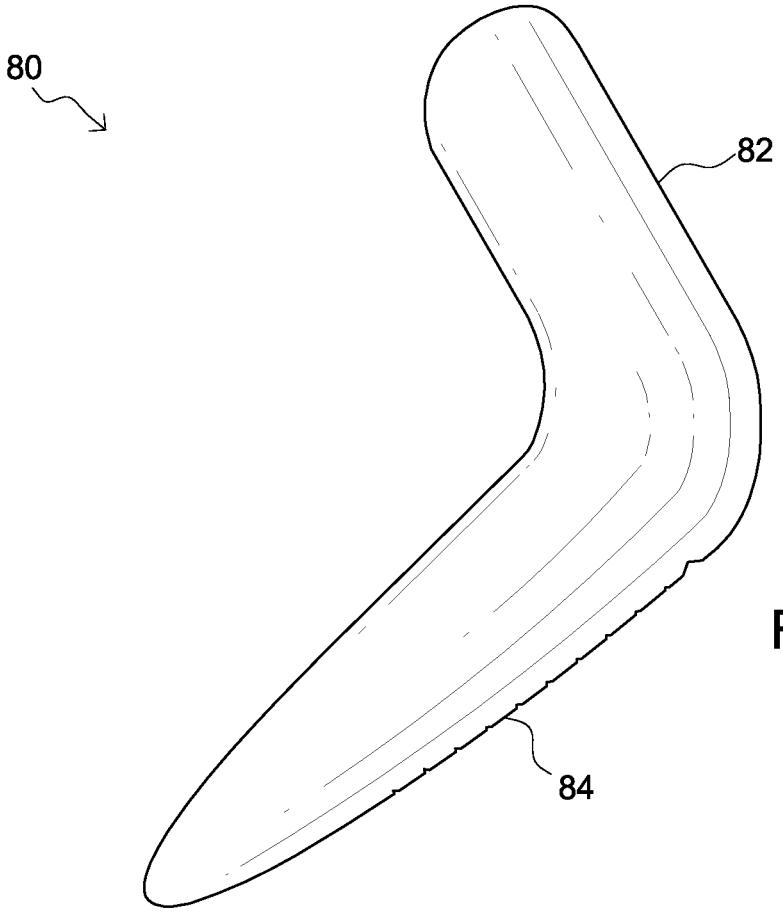
FIG. 12 is a front isometric view of a second embodiment purlicue stop for mounting to the side edge of a handheld device shown in its unfolded or unbent configuration prior to installation.
Figure 13:
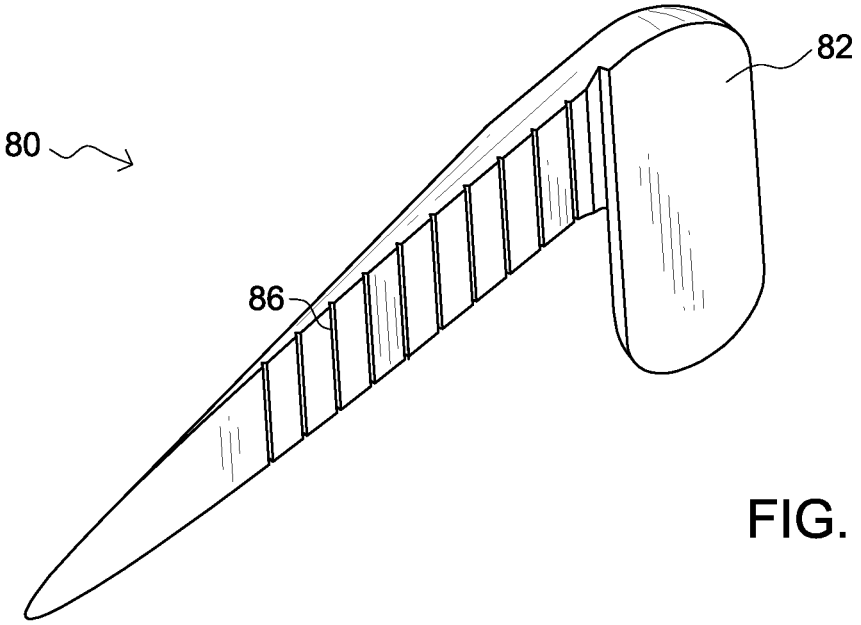
FIG. 13 is a rear isometric view of a second embodiment purlicue stop in its unfolded or unbent configuration prior to installation.
Figure 14:
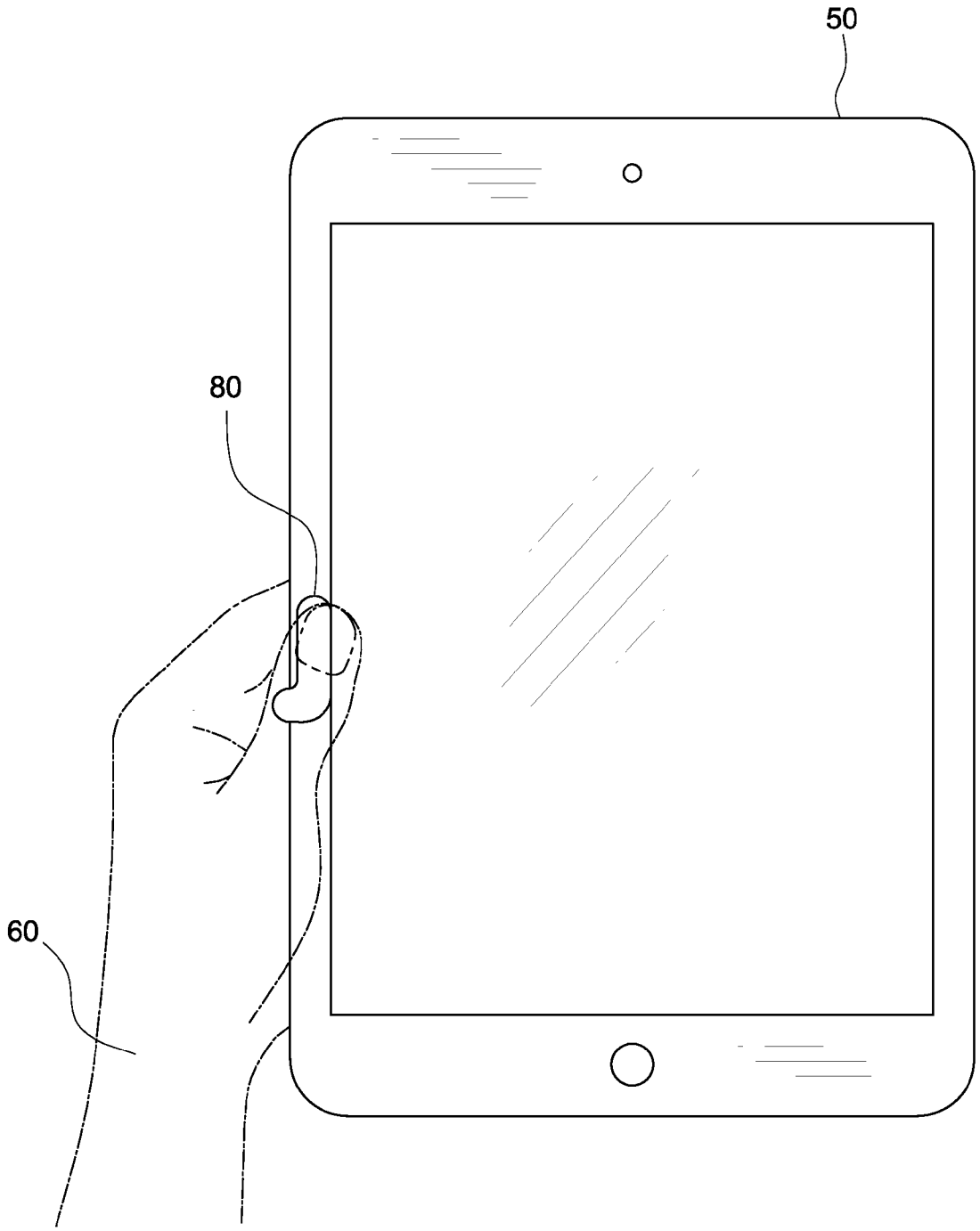
FIG. 14 is a frontside view of the second embodiment purlicue stop installed on a handheld device with a hand shown in dashed line showing how the stop is typically used.

A second embodiment purlicue stop is illustrated in FIGS. 12 & 13, and is shown installed on a handheld device in FIG. 14. Operationally, the second embodiment stop 80 is installed and performs in a similar manner to the first embodiment stop described above with a couple of distinctions. Most notably, the second embodiment incorporates an upwardly extending thumb brace portion 82. Another difference between the first and second purlicue stop embodiments is the lack of exterior ribs on the second embodiment stop, which has an essentially smooth top surface as can be seen in FIG. 12.

As shown in FIGS. 12 & 13 the second embodiment stop 80 is typically molded as a single piece of an elastomeric material. The stop is molded in the flat or unfolded configuration shown in the figures and comprises a general L-shape with the aforementioned thumb brace portion 82 being connected to a flexible finger portion 86 at a right angle. As best shown in the bottom view of FIG. 13, the finger portion's bottom surface includes a plurality of spaced laterally-extending slots 86. These slots effectively create a plurality of living hinges along the length of the finger portion that permit it to bend more easily around the edge of a handheld device. Of particular and important note, the bottom surface of the stop is typically covered with a pressure sensitive adhesive layer that holds the stop in place once fitted over the edge of the handheld device; however, the adhesive layer is omitted from FIG. 13 for purposes of clarity. As with the first embodiment purlicue stop, the finger portion 86 of the second embodiment can be fabricated include a malleable wire, rod or strip that helps the finger portion maintain its shape when wrapped around the edge of a handheld device.

The second embodiment stop is shown installed on a hand held device 50 in FIG. 14 with the hand 60 of a user illustrated in dashed line. Given the manner of placement, a user can brace his thumb against the inside edge of the brace portion applying pressure against the inside edge thereof. In concert with finger holds (not shown in FIG. 14 but as shown in FIG. 8), the user can more tightly grip an equipped hand held device than with just the finger holds alone.

An Embodiment Comprising a Combination of the Finger Holds and a Purlicue Stop

Aside from the finger holds and purlicue stops being sold separately, a plurality of Fingers holds 10 and typically at least four can be packaged, provided and/or sold in combination with a purlicue stop providing a user with a complete gripping solution for his/her handheld device.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

In some variations, the Design of the purlicure stops may include additional features that enhance its utility. For instance the height or depth of the finger portion can be increased such that the purlicue stop when placed on opposing edges of a hand held device can act as a stand propping the device at an angle when placed on a flat surface. The stop can further include deployable stand members that swing or project from the finger portion of the stop to further lift the handheld device and increase its angle relative to an underlying surface.

I claim:

1. In combination, a handheld device having a back side and a plurality of finger holds wherein each of the plurality of finger holds (i) being separate and distinct from each of the other finger holds and (ii) having a bottom side wherein the bottom side is adhesively secured directly to the back side, each of the finger holds defining a ridge, the ridge rising outwardly from the bottom side and including at least one ridge face, the ridge face of each of the finger holds facing generally in the same direction as the ridge faces one of the other finger holds, wherein each of the finger holds further includes an integrally formed planar foot portion and intersecting with the ridge at a base thereof, the bottom surface being part of the planar foot.

2. The combination of claim 1, wherein the ridge face of at least one of the finger holds is arcuate.

3. The combination of claim 2, further comprising a purlicue stop being of an elastomeric material.

4. The combination of claim 1, wherein the ridge face of each of the finger holds is arcuate.

5. The combination of claim 1, wherein each of the plurality of finger holds are adhesively secured to the back side by a pressure sensitive adhesive.

6. The combination of claim 1, wherein each of the finger holds is comprised of a polymeric material.

7. The combination of claim 6, wherein the polymeric material comprises an elastomer.

8. The combination of claim 1, further comprising a purlicue stop, the purlicue stop being wrapped around an edge of the handheld device.

9. The combination of claim 8, wherein the purlicue stop is adhesively secured to the edge by a pressure sensitive adhesive.

10. The combination of claim 1, wherein a perimeter shape of each of the planar foot portions comprises a decorative shape.

11. A method of using a handheld device using at least two finger holds, wherein each of the finger holds consists essentially of (i) a single crescent-shaped bumper having a height of about 0.125" defining a generally arcuate concave portion having an effective radius of 0.50" or less, (ii) a planar foot portion integrally formed with the crescent-shaped bumper including a bottom surface, and (iii) a pressure sensitive adhesive layer affixed to the bottom surface, the method comprising:

providing a handheld device having at least first and second finger holds attached to a backside of the handheld device; and holding the handheld device with one hand with a first fingertip being received in a first concave portion of the first finger hold and a second fingertip being received in a second concave portion of the second finger hold.

12. The method of claim 11, wherein each of the finger holds is comprised of an elastomer having a Shore A durometer of less than 70.

13. The method of claim 11, wherein a perimeter shape of the planar foot portion of each of the finger holds comprises a decorative shape.

14. The method of claim 11, further comprising:

adhesively securing the first finger hold to the backside of the handheld device at a position corresponding to a location that the first fingertip of a user normally rests when holding the handheld device; and adhesively securing the second finger hold to the backside of the handheld device at a position corresponding to a location that the second fingertip of the user normally rests when holding the handheld device.

15. The method of claim 11, wherein said providing the handheld device further includes providing the handheld device with a purlicue stop attached to an edge of the handheld device; and wherein said holding the handheld device further includes the purlicue stop resting upon a skin webbing between a thumb and forefinger of the one hand.

* * * * *